US008099006B2

(12) United States Patent
Fujimori et al.

(10) Patent No.: US 8,099,006 B2
(45) Date of Patent: Jan. 17, 2012

(54) IMAGE FORMING APPARATUS AND IMAGE QUALITY CORRECTION METHOD USED THEREIN

(75) Inventors: Kohta Fujimori, Yokohama (JP); Shin Hasegawa, Zama (JP); Nobutaka Takeuchi, Yokohama (JP); Hitoshi Ishibashi, Kamakura (JP); Kayoko Tanaka, Machida (JP); Yushi Hirayama, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 446 days.

(21) Appl. No.: 12/425,715

(22) Filed: Apr. 17, 2009

(65) Prior Publication Data

US 2009/0263150 A1 Oct. 22, 2009

(30) Foreign Application Priority Data

Apr. 18, 2008 (JP) ..... 2008-108969

(51) Int. Cl.
*G03G 15/00* (2006.01)

(52) U.S. Cl. ..... 399/49

(58) Field of Classification Search ..... 399/49, 399/53, 82

See application file for complete search history.

(56) References Cited

U.S. PATENT DOCUMENTS

| | | | | |
|---|---|---|---|---|
| 5,182,600 | A | 1/1993 | Hasegawa et al. | |
| 5,198,861 | A | 3/1993 | Hasegawa et al. | |
| 5,327,196 | A | 7/1994 | Kato et al. | |
| 5,387,965 | A | 2/1995 | Hasegawa et al. | |
| 5,508,787 | A | 4/1996 | Hasegawa et al. | |
| 5,630,195 | A | 5/1997 | Sawayama et al. | |
| 5,761,570 | A | 6/1998 | Sawayama et al. | |
| 5,857,131 | A | 1/1999 | Hasegawa | |
| 5,860,038 | A | 1/1999 | Kato et al. | |
| 6,055,386 | A | 4/2000 | Kato et al. | |
| 6,160,569 | A | 12/2000 | Fujimori et al. | |
| 6,496,677 | B2 | 12/2002 | Fujimori | |
| 6,983,111 | B2 * | 1/2006 | Ichikawa et al. | 399/49 |
| 7,228,081 | B2 | 6/2007 | Hasegawa et al. | |
| 7,251,420 | B2 | 7/2007 | Fujimori et al. | |
| 2004/0251435 | A1 | 12/2004 | Sawayama et al. | |
| 2008/0170220 | A1 | 7/2008 | Sawayama et al. | |

FOREIGN PATENT DOCUMENTS

| | | | |
|---|---|---|---|
| JP | 2002062713 | A * | 2/2002 |
| JP | 2002-229299 | | 8/2002 |
| JP | 2005-84543 | | 3/2005 |
| JP | 3804355 | | 5/2006 |
| JP | 2007-148134 | | 6/2007 |

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

An image forming apparatus includes multiple image forming units to form different single-color images with respective different color developers and a control system to selectively perform a multicolor image forming operation, a specific-color image forming operation, a multicolor image quality correction operation, and a specific-color image quality correction operation. The control system includes an image formation mode detection unit to ascertain which of the multicolor image forming operation and the specific-color image forming operation is performed prior to a request for image quality correction; and a correction instruction unit to order the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

19 Claims, 5 Drawing Sheets

IMAGE FORMING APPARATUS AND IMAGE QUALITY CORRECTION METHOD USED THEREIN

CROSS-REFERENCE TO RELATED APPLICATIONS

This patent specification is based on and claims priority from Japanese Patent Application No. 2008-108969, filed on Apr. 18, 2008 in the Japan Patent Office, the entire contents of which are hereby incorporated by reference herein.

BACKGROUND OF THE INVENTION

1. Field of the Invention

The present invention generally relates to an image forming apparatus such as a copier, a printer, a facsimile machine, a multifunction machine including at least two of those functions, and an image quality correction method used therein.

2. Discussion of the Background Art

In general, a multicolor image forming apparatus, such as a copier, a printer, a facsimile machine, or a multifunction machine including at least two of those functions, etc., forms multicolor images using multiple different color developers on sheets of recording media.

In addition, there are multicolor image forming apparatus that can switch between a multicolor mode and a monochrome mode.

FIG. 7 schematically illustrates a configuration of an electrophotographic multicolor image forming apparatus.

As shown in FIG. 7, the multicolor image forming apparatus includes four image forming units 100Y, 100C, 100M, and 100Bk each of which forms a different single-color image, for example, yellow, cyan, magenta, and black images electrostatically on a photoreceptor 200. Each of the image forming units 100Y, 100C, 100M, and 100Bk forms an electrostatic latent image on the photoreceptor 220 and then develops the latent image with the developer. The image forming apparatus further includes a transport belt 300 that is looped around multiple rollers such as a driving roller, a driven roller, and a support roller and is rotatable in a direction indicated by an arrow in FIG. 7 to transport a sheet of recording media. Each photoreceptor 200 contacts an outer surface of the transport belt 300, forming a transfer nip therebetween.

In the multicolor mode, the transport belt 300 contacts all four photoreceptors 200. As the transport belt 300 rotates, the different single-color images formed on the respective photoreceptors 200 are transferred therefrom and superimposed one on another on the sheet that is transported by the transport belt 300.

By contrast, in the monochrome mode, one of the rollers around which the transport belt 300 is looped around moves so as to disengage the transport belt 300 from other photoreceptors 200 than the photoreceptor 200 for black as indicated by a dotted line shown in FIG. 7. The purposed of such an operation is to reduce deterioration on and wear of the photoreceptors 200 that are not used in the monochrome mode, insofar as those photoreceptors 200 are not driven in the monochrome mode.

Additionally, multicolor image forming apparatuses generally include a mechanism for correcting image quality because changes in image density and/or relative positions of the respective single-color images can be caused over time, degrading image quality. Such changes are caused because operational conditions of the image forming units and/or environmental conditions change over time.

A typical image quality correction method includes forming a test pattern for image quality correction on each photoreceptor, transferring the test patterns from the respective photoreceptors onto the transport belt, and detecting the test patterns with a detector. Then, image quality is corrected based on image characteristic data obtained from results of the detection.

For example, in image quality correction, a known multicolor image forming apparatus forms an image density patch (graduation pattern) for each of yellow, cyan, magenta, and black that are color components of the multicolor image and then detects the image density patches with an optical sensor. However, this known image forming apparatus corrects image quality of all colors even when use frequency of the monochrome mode is higher than that of the multicolor mode, wasting respective color toners other than black toner.

To save color toners other than black toner, another known image forming apparatus switches between multicolor image quality correction and monochrome image quality correction as required. Image quality of all colors is corrected in multicolor image quality correction while image quality of only black is corrected in monochrome image quality correction. Thus, when black image quality requires correction, an image density patch for only black is formed, thereby saving respective color toners other than black toner.

Still, such a known image forming apparatus poses an inconvenience because the transport belt should be disengaged from those photoreceptors other than the photoreceptor for black when monochrome image quality correction mode is to be executed after the multicolor image forming mode is executed. In particular, when image quality correction is required during an image forming operation, the image forming operation is stopped and then the transport belt is disengaged from the photoreceptors other than the photoreceptor for black in order to correct image quality. The time period required for changing a position of the transport belt means downtime for the image forming apparatus.

In view of the foregoing, there is a need to reduce downtime due to image quality correction as well as to save toner, which known methods fail to do.

SUMMARY OF THE INVENTION

In view of the foregoing, in one illustrative embodiment of the present invention, an image forming apparatus includes multiple image forming units to form different single-color images respectively with different color developers, and a control system communicably connected to the multiple image forming units to selectively perform a multicolor image forming operation, a specific-color image forming operation, a multicolor image quality correction operation, and a specific-color image quality correction operation. The control system includes an image formation mode detection unit to ascertain which of the multicolor image forming operation and the specific-color image forming operation is performed prior to a request for image quality correction, and a correction instruction unit to order the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

In another illustrative embodiment of the present invention, a tandem image forming apparatus includes multiple image forming units each of which forms a different single-color image on an image carrier with a different color developer, a rotary transport belt disposed to contact the respective image carriers, a detector disposed to face an outer surface of the transport belt to detect a test pattern formed on the transport belt, a disengagement member, and the control system described above.

Transfer nips are formed between the transport belt and the respective image carriers, where the different color images are transferred from the image carriers onto one of the transport belt and a sheet of recording media transported by the transport belt. The disengagement member disengages the transfer belt from the multiple image carriers other than the image carrier for a specific color when either a specific-color image forming operation or a specific-color image quality correction operation is performed.

Yet another illustrative embodiment of the present invention provides an image quality correction method used in the image forming apparatuses described above. The image quality correction method includes determining whether or not image quality correction is necessary, selecting either the multicolor image quality correction operation or the specific-color image quality correction operation based on data on the image quality correction deemed necessary, requesting the selected image quality correction operation, ascertaining which of the multicolor image forming operation and the specific-color image forming operation is performed prior to the request for the image quality correction, and performing the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
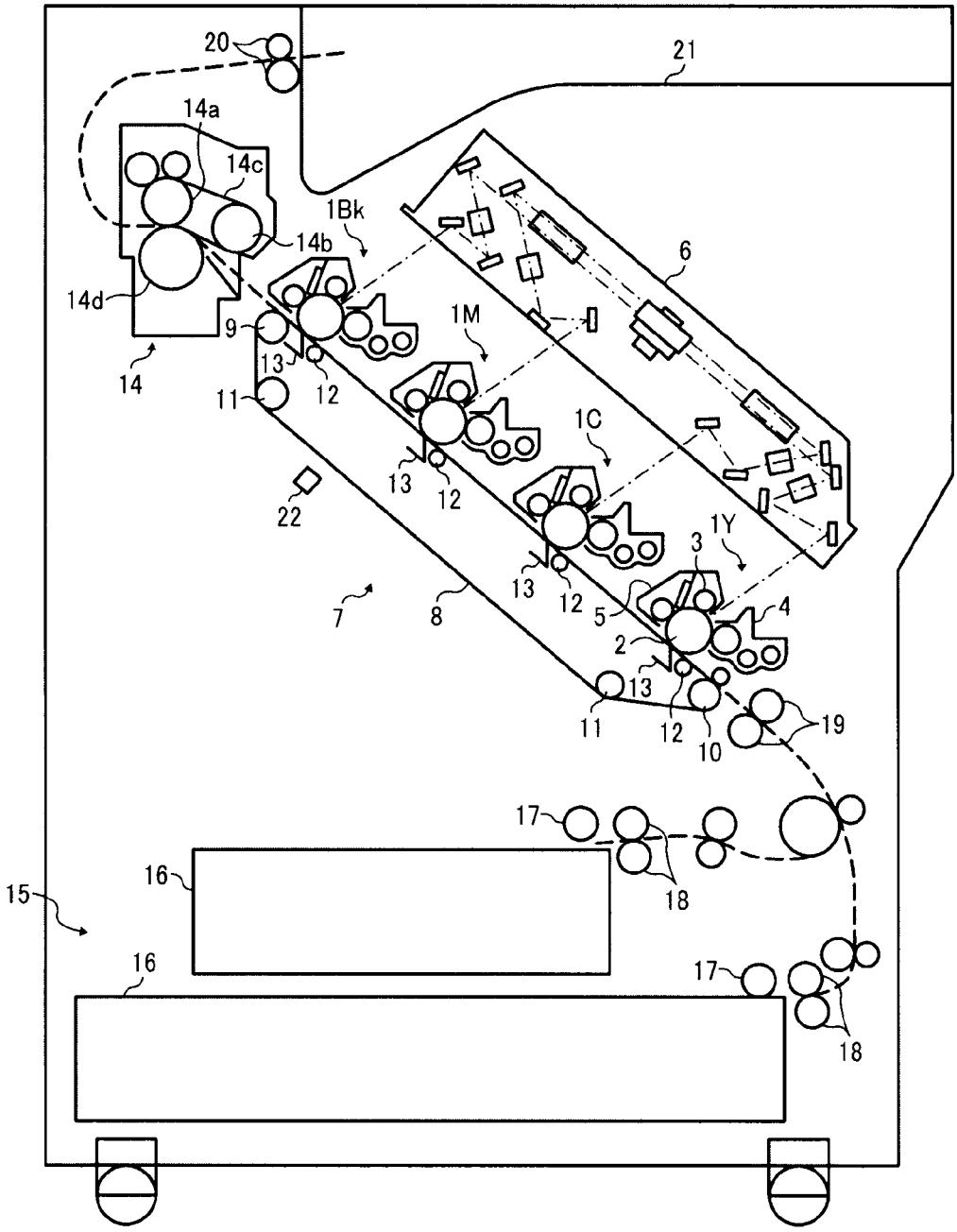
FIG. 1 illustrates a schematic configuration of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a color image forming apparatus according to an illustrative embodiment of the present invention is described. It is to be noted that reference characters Y, M, C, and Bk represent yellow, magenta, cyan, and black, respectively, and may be omitted when color discrimination is not required in the description below.

Referring to FIG. 1, the image forming apparatus includes image forming units 1Y, 1C, 1M, and 1Bk that respectively form single-color images using yellow, cyan, magenta, and black toner (developers) that are components of multicolor images. It is to be noted that the colors of the toners used in the image forming apparatus are not limited to the four colors of yellow, cyan, magenta, and black. Similarly, the number of the colors is not limited to four as long as multiple different colors are used.

The image forming units 1Y, 1C, 1M, and 1Bk have a similar configuration except the color of the toner used to form images, and each image forming unit 1 includes a photoreceptor 2 serving as an image carrier, a charger 3 to charge a surface of the photoreceptor 2, a developing unit 4 to supply the toner to the electrostatic latent image formed on the photoreceptor 2, and a cleaner 5 to clean the surface of the photoreceptor 2. As the cleaner 5, a cleaning blade, a cleaning roller, a cleaning brush, and the like can be used alone or in combination.

The image forming apparatus further includes an exposure unit 6 disposed above the image forming units 1 in FIG. 1, a transfer and transport unit 7 disposed beneath the image forming units 1 in FIG. 1, and a sheet feeder 15 disposed in a lower portion thereof.

The transfer and transport unit 7 includes a transport belt 8 looped around a driving roller 9, a driven roller 10, and rollers 11, auxiliary rollers 12, and bias members 13. An outer surface of the transport belt 8 contacts the respective photoreceptors 2, forming transfer nips. The auxiliary rollers 12 are pressed against an inner surface of the transport belt 8 by springs, not shown at positions close to the respective transfer nips. For example, each bias member 13 can be an electroconductive brush, an electroconductive roller, or the like and contacts the inner surface of the transport belt 8 at the transfer nip. A transfer bias is applied to the bias member 13 from a power source, not shown, and further to the transport belt 8.

The sheet feeder 15 includes sheet cassettes 16 each of which contains multiple sheets of recording media such as transfer paper and OHP (Overhead Projector) film. Each sheet cassette 16 is provided with a pick-up roller 17 that separates multiple sheets contained in the sheet cassette 16 and a feed roller 18 to forward the sheet separated by the pick-up roller 17 to the image forming units 1.

The image forming apparatus further includes a fixer 14 disposed on the upper left of the transfer and transport unit 7, a pair of registration rollers 19 disposed on the lower right of the transfer and transport unit 7 in FIG. 1, a discharge roller 20, a stack unit 21, and a detector 22 that faces the outer surface of the transport belt 8 to detect test patterns used to correct image quality.

The fixer 14 includes a fixing roller 14*a*, a heating roller 14*b*, a fixing belt 14*c* looped around the fixing roller 14*a* and the heating roller 14*b*, and a pressure roller 14*d*. The pressure roller 14*d* presses against the fixing roller 14*a* via the fixing belt 14*c*, forming a fixing nip therebetween.

The transfer and transport unit 7 is described below in further detail with reference to FIG. 2.

Figure 2:
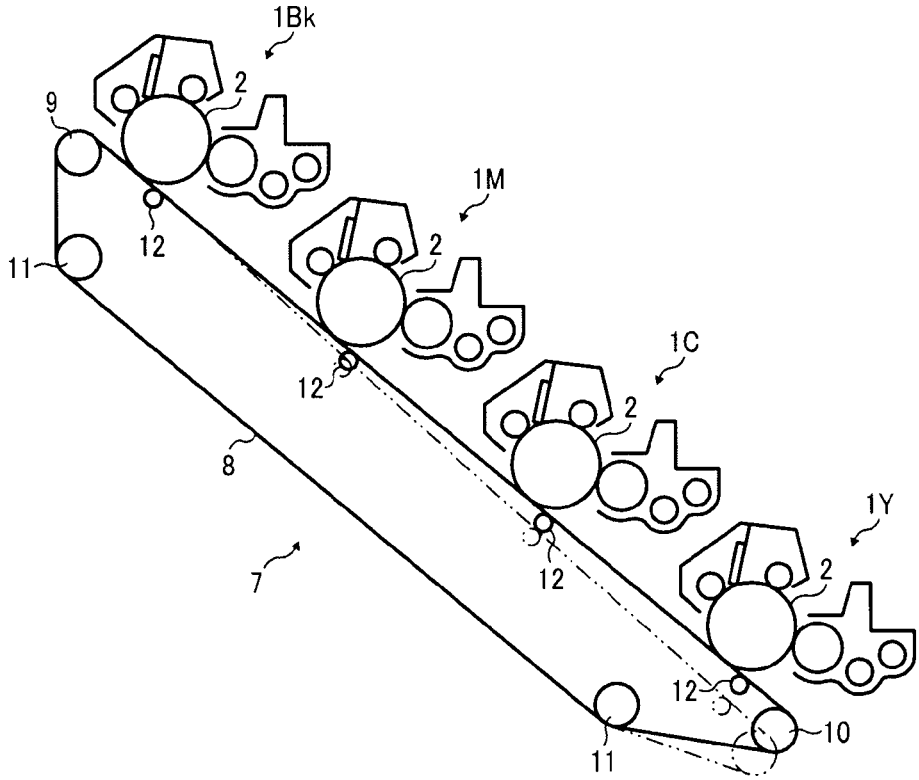
FIG. 2 schematically illustrates four image forming units and a transport belt included in the image forming apparatus shown in FIG. 1.

FIG. 2 illustrates the transfer and transport unit 7 and the image forming units 1Y, 1C, 1M, and 1Bk.

Referring to FIG. 2, in the present embodiment, the driven roller 10 and at least one auxiliary roller 11 are movable and serve disengagement members that disengage the transport belt 8 from the photoreceptors 2 for yellow, cyan, and magenta, engaging the transport belt 8 with only the photoreceptor 2 for black, as indicated by a dotted line in FIG. 2.

In other words, the transport belt 8 can be switched between a first position, indicated by a solid line in FIG. 2, at which the transport belt 8 engages all the photoreceptors 2 and a second position, indicated by the dotted line in FIG. 2, at which the transport belt 8 engages only the photoreceptor 2 for black.

The image forming apparatus further includes an image quality correction mechanism to correct image density, deviations in relative positions of the respective single-color images, and the like, which is described below with reference to FIGS. 3 through 5.

Figure 3:
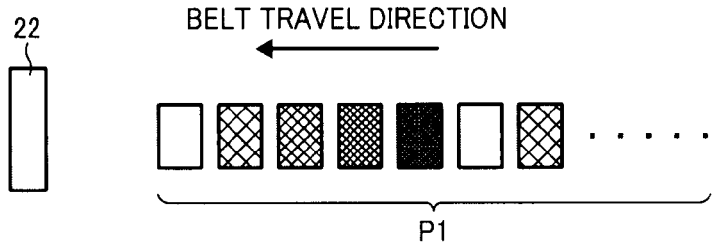
FIG. 3 illustrates a graduation pattern used for image density correction.
Figure 4:
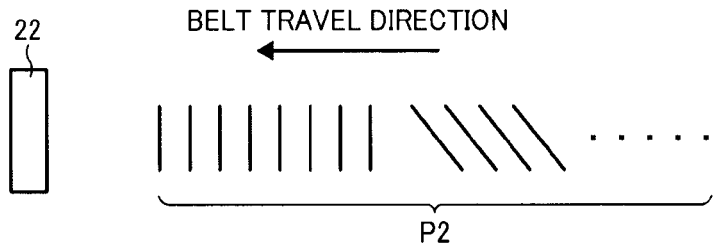
FIG. 4 illustrates a line pattern used for relative position correction.

The image quality correction mechanism includes the image forming units 1 shown in FIG. 1 as pattern forming units each of which forms a graduation pattern P1 shown in FIG. 3 and a line pattern P2 shown in FIG. 4, and the detector 22 shown in FIG. 1 to detect those patterns. The graduation pattern P1 is used to correct image density, and the line pattern P2 is used to correct the relative positions of the single-color images, distortion of the images, or the like. The detector 22 can be an optical sensor.

It is to be noted that the image forming units 1 can be configured to form test patterns to correct other image qualities than image density and the relative positions of the single-color images.

Figure 5:
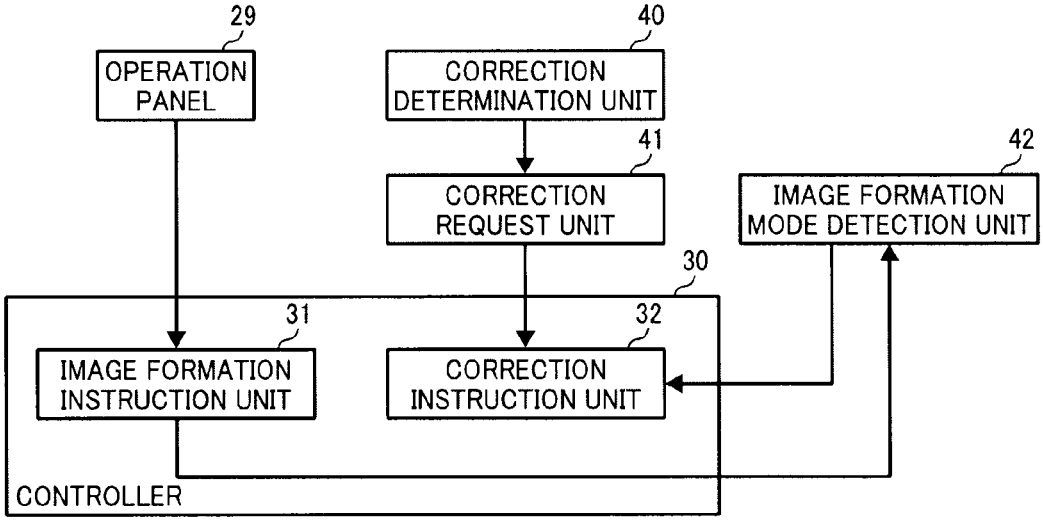
FIG. 5 is a block diagram illustrating a control system of the image forming apparatus shown in FIG. 1.

FIG. 5 is a block diagram illustrating a control system 100 of the image forming apparatus shown in FIG. 1.

As shown in FIG. 5, the control system 100 includes an operations panel 29 serving as an operation unit, which may, for example, be provided on an upper surface of the image forming apparatus, a controller 30 to control operations of the image forming units 1, a correction determination unit 40, a correction request unit 41, and an image formation mode detection unit 42. The controller 30 includes an image formation instruction unit 31 and a correction instruction unit 32. Further, the control system 100 can communicate with the detector 22 shown in FIG. 1.

The image forming apparatus according to the present embodiment can selectively switch between a multicolor image formation mode (hereinafter "multicolor mode") in which all the image forming units 1 are active and single-color image formation mode in which one of the four image forming units 1 is active. In the present embodiment, the image forming unit 1Bk is active and forms monochrome images in the-single-color image formation (hereinafter "monochrome mode"). The image formation instruction unit 31 issues instructions to execute either multicolor image formation or monochrome image formation.

Further, the image forming apparatus according to the present embodiment can selectively switch between a multicolor image quality correction mode in which all the image forming units 1 are active and a specific-color image quality correction mode in which one of the four image forming units 1 is active. In the present embodiment, only the image forming unit 1Bk is active to correct black image quality in specific-color image quality correction operation (hereinafter "monochrome correction operation"). The correction instruction unit 32 issues instructions to execute either the multicolor image quality correction operation (hereinafter "multicolor correction operation") or the monochrome correction operation.

The operation panel 29 is used by a user to instruct the mage formation instruction unit 31 to execute image formation. The user can select either the multicolor mode or the monochrome mode and then cause the image formation instruction unit 31 to order image formation in the selected mode via the operation panel 29.

The correction determination unit 40 determines whether or not image quality correction is required automatically based on predetermined or given criteria.

The correction request unit 41 selects either the multicolor correction operation or the monochrome correction operation based on the image quality that is deemed to require correction by the correction determination unit 40 and then requests the selected image quality operation.

The image formation mode detection unit 42 ascertains whether an image forming operation preceding the request for image quality correction is in the multicolor mode or in the monochrome mode.

Descriptions will be given below of multicolor image formation with reference to FIGS. 1, 2, and 5.

When the user selects multicolor image formation via the operation panel 29, the image formation instruction unit 31 sets the transport belt 8 at the first position, indicated by the solid line in FIG. 2, at which the transport belt 8 engages all the photoreceptors 2 for yellow, cyan, magenta, and black.

Referring to FIG. 1, in the image forming unit 1Y, the charger 3 charges the surface of the photoreceptor 2 to a relatively high electrical potential uniformly while the photoreceptor 2 rotates. Then, the exposure unit 6 directs laser light onto the surface of the photoreceptor 2 according to image information for yellow. Thereby, the potential of the portion exposed to the laser light is reduced, and thus an electrostatic latent image is formed thereon. Then, the developing unit 4 supplies the yellow toner to the electrostatic latent image electrostatically, developing the electrostatic latent image into a yellow toner image. Similarly, the image forming units 1C, 1M, and 1Bk form cyan, magenta, and black toner images on the respective photoreceptors 2.

While the toner images are thus formed, in the sheet feeder 15, the pick-up roller 17 rotates to separate the sheets contained in the sheet cassette 16 one by one, and then the feed roller 18 feeds the sheet to the registration rollers 19 that stops the sheet.

The registration rollers 19 forward the sheet to the transport belt 8 after the images are formed on the respective photoreceptors 2. In the image forming unit 1Y, the photoreceptor 2 rotate to transport the yellow image to the transfer nip. Simultaneously, as the transport belt 8 rotates counterclockwise in FIG. 1, which is hereinafter referred to as the belt travel direction, the sheet thereon reaches the transfer nip in the image forming unit 1Y where the transfer bias is applied from the bias member 13. With the transfer bias, the toner image on the photoreceptor 2 is electrostatically transferred onto the sheet.

More specifically, in the present embodiment, the yellow toner image is initially transferred from the photoreceptor 2 onto the sheet. Subsequently, the cyan, magenta, and black images are sequentially transferred from the photoreceptors 2 and superimposed one on another in that order on the yellow image on the sheet, forming a multicolor image thereon.

The sheet is then transported to the fixer 14 and then heated and pressed by being sandwiched between the fixing roller 14*a* and the pressure roller 14*d* to fix the multicolor image on the sheet. Then, the discharge rollers 20 discharge the sheet onto the stack unit 21.

After the toner image is transferred from each photoreceptor 2 onto the sheet, the cleaner 5 removes any toner remaining thereon.

By contrast, when the user selects the image formation in the monochrome mode via the operation panel 29, the image formation instruction unit 31 sets the transport belt 8 at the second position, indicated by the dotted line in FIG. 2, at which the transport belt 8 engages only the photoreceptor 2 for black.

Similar to the operations described above, a black toner image is formed on the photoreceptor 2 in the image forming unit 1Bk, and then transferred onto the sheet transported by the transport belt 8. After the black image is fixed by the fixer 14, the sheet is discharged onto the stack unit 21.

Next, the image quality correction operation in the image forming apparatus according to the present embodiment is described below with reference to FIG. 5 and a flowchart shown in FIG. 6.

When image formation is requested, at S1 the correction determination unit 40 determines whether or not image quality correction is necessary. More specifically, for example, the correction determination unit 40 determines whether or not three types of image quality correction are necessary as follows:

(i) Correction of image density of only black is necessary when the number of sheets on which only black images are formed reaches 200 after previous correction of image density of either only black images (hereinafter "monochrome density correction operation") or that of all the four colors (hereinafter "multicolor density correction operation").

(ii) Correction of image density of all the four colors is necessary when the number of sheets on which multicolor images are formed reaches 200 after a previous multicolor density correction operation.

(iii) Correction of the relative positions of respective single-color images (hereinafter "relative position correction") is necessary when changes in an ambient temperature exceeds 5 degrees centigrade after a previous relative position correction operation.

When the correction determination unit 40 determines that at least one of those types of image quality correction is necessary (YES at S1), the correction determination unit 40 transmits data on the image quality correction that is necessary to the correction request unit 41. When image quality correction is deemed necessary during an image forming operation, the image forming operation is interrupted.

By contrast, when the correction determination unit 40 determines that none of the three types of image quality correction is necessary, the correction determination unit 40 continues to monitor whether or not the above-described criteria for determining the need for image quality correction are satisfied.

At S2, the correction request unit 41 selects either the multicolor correction operation or the monochrome correction operation based on the data on the image quality correction and then requests the correction instruction unit 32 to order the selected image quality correction operation.

More specifically, the monochrome correction operation is requested when the monochrome density correction operation is necessary.

By contrast, the multicolor correction operation is requested when at least one of the multicolor density correction and the relative position correction is necessary, or when both the monochrome density correction and the relative position correction are simultaneously necessary.

It is to be noted that, when the image forming apparatus is set so that the user cannot request high quality multicolor image formation or when the user selects that high quality multicolor images are not necessary, the correction request unit 41 can request the monochrome correction operation even when the multicolor image density correction is deemed necessary.

When the multicolor correction operation is requested at S2, at S3 the correction instruction unit 32 checks whether or not the image quality correction operation is executable. Because any sheet being on a sheet transport path in the image forming apparatus must be held at a predetermined or given position when the image quality correction operation is performed, the image forming apparatus further includes a sensor, not shown, to ascertain whether or not such a sheet is held at the predetermined position.

When the correction instruction unit 32 has ascertained that the image quality correction operation is executable (YES at S3), at S4 the correction instruction unit 32 issues instructions to execute the multicolor correction operation. By contrast, when the image forming apparatus is not prepared (NO at S3), the process does not proceed to S4 until the preparation is completed.

In the multicolor correction operation, the transport belt 8 is at the first position, indicated by the solid line shown in FIG. 2, to engage all the photoreceptors 2. Subsequently, the image forming units 1 form the test patterns on the respective photoreceptors 2. More specifically, the graduation pattern P1 shown in FIG. 3 is formed on each photoreceptor 2 in the multicolor image density correction, and the line pattern P2 shown in FIG. 4 is formed on each photoreceptor 2 to correct the relative positions and/or distortion of the images. Then, the test patterns are sequentially transferred from the photoreceptors 2 onto the transport belt 8. The test patterns for respective colors are not superimposed one on another but in line on the transport belt 8.

It is to be noted that formation and transfer of the test patterns are similar the above-described image formation and image transfer, and thus descriptions thereof are omitted.

Subsequently, referring to FIG. 1, the test patterns are transported to a position facing the detector 22 as the transport belt 8 rotates and are detected by the detector 22. Then, a correction unit, not shown, corrects image formation parameters such as development bias of the development unit 4, charge bias of the charger 3, exposure power of the exposure unit 6, and the like based on detection signals from the detector 22. Thus, the image quality correction operation is completed. If an image forming operation has been interrupted by the image quality correction, it is restarted.

By contrast, when the monochrome correction operation is requested at S2, at S5 the correction instruction unit 32 checks whether or not the image quality correction operation is executable. More specifically, the correction instruction unit 32 checks whether or not any sheet on the sheet transported path in the image formation apparatus is held at the predetermined or given position.

When the image quality correction is executable (YES at S5), at S6 the image formation mode detection unit 42 checks whether an image forming operation preceding the request for the image quality correction or an image forming operation interrupted by the request is in the multicolor mode or in monochrome mode. When the image forming apparatus is not prepared, the process does not proceed to S6 until the preparation is completed.

Subsequently, when the image formation mode detection unit 42 ascertains that the preceding or interrupted image forming operation is in the multicolor mode at S6, at S7 the correction instruction unit 32 issues instructions to execute the multicolor correction operation not the monochrome correction operation. In the multicolor correction operation, operations similar to those performed at S4 are performed. Then, the multicolor correction operation is completed, and the image forming operation that has interrupted is restarted.

By contrast, when the image formation mode detection unit 42 ascertains that the preceding or interrupted image forming operation is in the monochrome mode at S6, at S8 the correction instruction unit 32 issues instructions to execute the monochrome correction operation.

In the monochrome correction operation, the transport belt 8 is set to the second position indicated by the dotted line in FIG. 2, thus being disengaged from the three photoreceptors 2 for yellow, cyan, and magenta. Subsequently, the image forming unit 1Bk forms the graduation pattern P1 shown in FIG. 3 or the line pattern P2 shown in FIG. 4, and this test pattern is then transferred from the photoreceptor 2 onto the transport belt 8. Then, the detector 22 detects the test pattern, and the correction unit, not shown, corrects the image formation parameters for black images based on detection signals from the detector 22. Thus, the monochrome correction operation is completed. When an image forming operation has been interrupted by the image quality correction, that image forming operation is restarted.

Features of the image quality correction performed in the image forming apparatus according to the present embodiment are described below.

Figure 6:
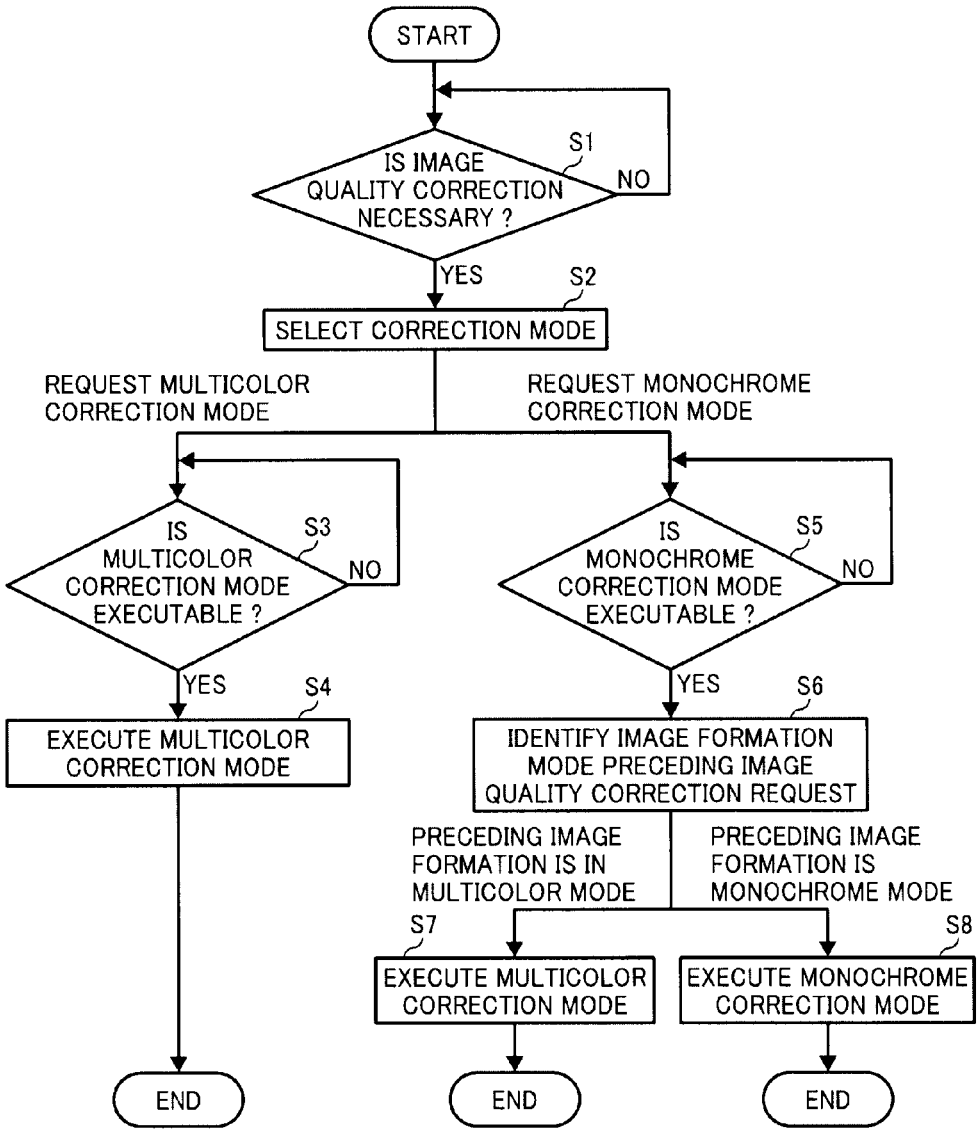
FIG. 6 is a flowchart of image quality correction used in the image forming apparatus shown in FIG. 1.
Figure 7:
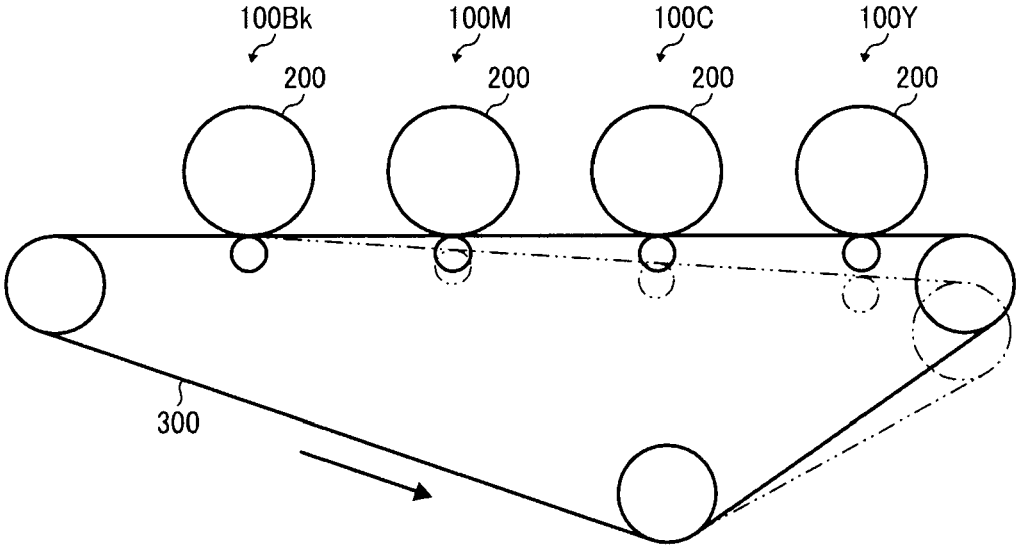
FIG. 7 RELATED ART
FIG. 7 schematically illustrates a configuration of a known multicolor image forming apparatus.

In the present embodiment, in principle, the multicolor correction operation is performed when toner images of all the colors used in the mage forming apparatus require correction (at S4 in FIG. 6), and the monochrome correction operation is performed when only black toner images require correction (at S8 in FIG. 6).

In other words, the image forming apparatus according to the present embodiment can select one of the multicolor correction operation and the monochrome correction operation that is necessary and execute the selected correction operation. Therefore, toner consumption can be reduced compared with a case in which the multicolor image quality correction operation is performed anytime image quality correction is required.

However, in the present embodiment, when a multicolor image forming operation is performed immediately prior to the request for the image quality correction, not the monochrome but multicolor correction operation is performed (at S7 in FIG. 6) as described above. In other words, even when the monochrome correction operation is requested, the multicolor correction operation is performed anytime image correction is requested after a multicolor image forming operation.

Therefore, when the image forming apparatus proceeds to image quality correction from the image forming operation, it is not necessary to switch the position of the transport belt 8. Thereby, downtime due to position change of the transport belt 8 can be eliminated, reducing total downtime of the image forming apparatus. Further, position change of the transport belt 8 can be eliminated in restarting the interrupted image forming operation as well, reducing the total downtime of the image forming apparatus.

Additionally, the present invention is not limited to the above-described embodiment. Thus, the present invention is applicable to an intermediate (indirect) transfer image forming apparatus in which single-color images are primarily transferred from the photoreceptors and superimposed one on another on an intermediate transfer belt, and the superimposed image is then transferred onto a sheet.

Additionally, the present invention may be embodied as an image quality correction method used in an image forming apparatus that includes multiple image forming units each of which uses a different color developer and performs image formation and image quality correction selectively either in a multicolor mode or a specific-color mode such as monochrome mode.

This method is applicable not only to the above-described electronographic image forming apparatuses but also to liquid-ejecting image forming apparatuses that form images by ejecting ink droplets from a recording head onto a sheet.

As can be appreciated by those skilled in the art, although the description above concerns the intermediate transfer method, the above-described control of the transfer bias may be used in a direct transfer method in which a toner image on a photoreceptor is transferred directly onto a sheet of recording medium.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

multiple image forming units to form different single-color images with respective different color developers; and a control system communicably connected to the multiple image forming units to selectively perform a multicolor image forming operation, a specific-color image forming operation, a multicolor image quality correction operation, and a specific-color image quality correction operation, the control system including:

an image formation mode detection unit to ascertain which of the multicolor image forming operation and the specific-color image forming operation is performed prior to a request for image quality correction; and a correction instruction unit to order the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

2. The image forming apparatus according to claim 1, wherein the control system further comprises:

a correction determination unit to determine whether or not the image quality correction is necessary; and a correction request unit to select either the multicolor image quality correction operation or the specific-color image quality correction operation based on data on the image quality correction deemed necessary by the correction determination unit and to send a request for the selected image quality correction operation to the correction instruction unit.

3. The image forming apparatus according to claim 2, wherein the correction determination unit determines a need for at least one of relative position correction of all the different colors, image density correction of all the different colors, and image density correction of the specific color.

4. The image forming apparatus according to claim 3, wherein, when the correction determination unit determines that the relative position correction of all the different colors is necessary, the correction request unit requests the multicolor image quality correction operation.

5. The image forming apparatus according to claim 3, wherein the image density correction of the specific color is deemed necessary when a number of sheets on which only the specific-color images are formed reaches a predetermined number after the image density of either only the specific-color images or the image density of all the different colors is corrected.

6. The image forming apparatus according to claim 3, wherein, when the image density correction of the specific color and the relative position correction of all the different colors are simultaneously necessary, the multicolor image quality correction operation is requested.

7. The image forming apparatus according to claim 3, wherein, when high quality multicolor images are not necessary, the specific-color image quality correction operation is requested even when the image density correction of all the different colors is deemed necessary.

8. The image forming apparatus according to claim 1, and further comprising:

a rotary transport belt disposed to contact an image carrier of each of the multiple image forming units, forming a transfer nip where the different color image is transferred from the image carrier onto one of the transport belt and a sheet of recording media transported by the transport belt; and a disengagement member to disengage the transfer belt from the multiple image carriers except that for the specific color when either the specific-color image formation or the specific-color image quality correction is performed.

9. The image forming apparatus according to claim 8, and further comprising a detector communicably connected to the control system and disposed to face an outer surface of the transport belt to detect a test pattern formed on the transport belt, wherein an image formation parameter is adjusted based on an detection signal from the detector in the image quality correction.

10. A tandem image forming apparatus comprising:

multiple image forming units each of which forms a different single-color image on an image carrier with a different color developer;

a rotary transport belt disposed to contact the respective image carriers, forming transfer nips where the different color images are transferred from the image carriers onto one of the transport belt and a sheet of recording media transported by the transport belt; and a disengagement member to disengage the transfer belt from the multiple image carriers except that for a specific color when either a specific-color image forming operation or a specific-color image quality correction operation is performed;

a detector disposed to face an outer surface of the transport belt to detect a test pattern formed on the transport belt; and a control system communicably connected to the multiple image forming units to selectively perform a multicolor image forming operation, the specific-color image forming operation, a multicolor image quality correction operation, and the specific-color image quality correction operation, the control system including:

an image formation mode detection unit to ascertain which of the multicolor image forming operation and the specific-color image forming operation is performed prior to a request for image quality correction; and a correction instruction unit to order the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

11. The tandem image forming apparatus according to claim 10, wherein the control system further comprises:

a correction determination unit to determine whether or not the image quality correction is necessary; and a correction request unit to select either the multicolor image quality correction operation or the specific-color image quality correction operation based on data on the image quality correction deemed necessary by the correction determination unit and to request the selected image quality correction operation.

12. The image forming apparatus according to claim 11, wherein the correction determination unit determines a need for at least one of relative position correction of all the different colors, image density correction of all the different colors, and image density correction of the specific color.

13. An image quality correction method used in an image forming apparatus, the image forming apparatus including multiple image forming units to form different single-color images with different color developers, respectively, and a control system communicably connected to the multiple image forming units to selectively perform a multicolor image forming operation, a specific-color image forming operation, a multicolor image quality correction operation, and a specific-color image quality correction operation, the image quality correction method comprising:

determining whether or not image quality correction is necessary;

selecting either the multicolor image quality correction operation or the specific-color image quality correction operation based on data on the image quality correction deemed necessary;

requesting the selected image quality correction operation;

ascertaining which of the multicolor image forming operation and the specific-color image forming operation is performed prior to the request for the image quality correction; and performing the multicolor image quality correction operation when the multicolor image quality correction operation is requested, the specific-color correction operation when the specific-color image quality correction operation is requested after the specific-color image forming operation, and the multicolor image quality correction operation when the specific-color image quality correction operation is requested after the multicolor image forming operation.

14. The image quality correction method according to claim 13, wherein a need for at least one of relative position correction of all the different colors, image density correction of all the different colors, and image density correction of the specific color is determined.

15. The image quality correction method according to claim 14, wherein, when the relative position correction of all the different colors is necessary, the multicolor image quality correction operation is requested.

16. The image quality correction method according to claim 14, wherein the image density correction of the specific color is deemed necessary when a number of sheets on which only the specific-color images are formed reaches a predetermined number after the image density of either only the specific-color images or the image density of all the different colors is corrected.

17. The image quality correction method according to claim 14, wherein, when the image density correction of the specific color and the relative position correction of all the different colors are simultaneously necessary, the multicolor image quality correction operation is requested.

18. The image quality correction method according to claim 14, wherein, when high quality multicolor images are not necessary, the specific-color image quality correction operation is requested even when the image density correction of all the different colors is deemed necessary.

19. The image quality correction method according to claim 13, further comprising ascertaining whether or not a sheet being on a transport path in the image forming apparatus is held at a predetermined position.

* * * * *